US005544488A

United States Patent [19]

Reid

[11] Patent Number: 5,544,488

[45] Date of Patent: Aug. 13, 1996

[54] SELF-POWERED HEAT TRANSFER FAN

[76] Inventor: Randall H. Reid, R.R.#4, Wiarton, Ontario, Canada, N0H 2T0

[21] Appl. No.: 287,306

[22] Filed: Aug. 8, 1994

[30] Foreign Application Priority Data

Aug. 10, 1993 [CA] Canada ..... 2103734

[51] Int. Cl.[6] ..... F25B 21/02

[52] U.S. Cl. ..... 62/3.7; 136/204

[58] Field of Search ..... 62/3.2, 3.7; 136/204, 136/205

[56] References Cited

U.S. PATENT DOCUMENTS

| | | | |
|---|---|---|---|
| 664,776 | 12/1900 | Porter | 136/204 |
| 1,118,269 | 11/1914 | Creveling | 62/3.2 |
| 2,519,241 | 8/1950 | Findley | 136/205 |
| 3,082,276 | 3/1963 | Corry et al. | 62/3.2 |
| 3,150,656 | 9/1964 | Huber | 136/204 |
| 3,602,001 | 8/1971 | Bauer | 62/3.7 |
| 4,296,733 | 10/1981 | Saunders | 126/428 |
| 4,472,945 | 9/1984 | Cech et al. | 62/3.3 |
| 4,843,273 | 6/1989 | Dammers et al. | 310/306 |

OTHER PUBLICATIONS

Tellurex Thermoelectric (TE) Demonstration Devices —Tellurex Corporation 1248 Hastings —Traverse City, Michigan 49684 Fax No. 616-947-5821 Tel No. 616-947-0110.

*Primary Examiner*—Henry A. Bennett
*Assistant Examiner*—William C. Doerrler
*Attorney, Agent, or Firm*—Cushman Darby & Cushman, L.L.P.

[57] ABSTRACT

A self-powered fan for circulating air for use in cooperation with a heat source, said fan comprising a heat transfer member having a heat transfer surface operably cooperable with said heat source, electric motor, fan blades, thermocouple means cooperable with said electric motor and said heat transfer member, the improvement comprising said heat transfer member being of suitable size, mass and shape as to provide a suitable temperature gradient between said thermocouple means and said heat source to operably allow of sufficient heat transfer from said heat transfer member to said thermocouple means to generate sufficient power to effect rotation of said blades but not to cause thermal damage to said thermocouple means.

8 Claims, 10 Drawing Sheets

SELF-POWERED HEAT TRANSFER FAN

FIELD OF THE INVENTION

This invention relates to heat transfer fans, particularly to such fans for use in conjunction with cooled or heated surfaces, and more particularly, with fossil-fuel burning stoves.

BACKGROUND TO THE INVENTION

Heating units such as wood and other fossil-fuel combustible material burning stoves, hot water radiators and the like disseminate heat into surrounding space by radiation and by convection of thermal air currents circulating around the unit. Warm air distribution from the unit may be enhanced by means of an air blower or fan suitably placed on or adjacent the unit. Presently, such air circulating fans are powered by electric battery or mains power supply.

It is known through the so-called "Peltier Effect" that when a direct electric current is passed through a thermoelectric couple, heat will be absorbed at one end of the couple to cause cooling thereof, while heat is rejected at the other end of the couple to cause a rise in temperature. By reversing the current flow, the direction of heat flow will be reversed.

Thermoelectric modules are forms of a thermoelectric couple and, typically, comprise an array of semiconductor couples (P and N pellets) connected electrically in series and thermally in parallel, sandwiched between metallized ceramic substrates.

In a reverse manner, by the so-called "Seebeck Effect", a thermoelectric module behaves like a simple thermocouple in generating an electric potential across its terminals if a temperature gradient or thermocline is provided across the module when in an open circuit mode. Thus, electric power is generated as a function of the temperature difference between both ends of the module.

Pertinent prior art comprises a demonstration model of a power generation module powering an air circulation fan disclosed by Tellurex Corporation, Michigan, U.S.A. The Tellurex Corporation self-powered fan comprises a hot end heat exchanger heated by a hand-held propane torch, electric motor, fan blades, a cold end heat exchanger and a thermoelectric module sandwiched in thermal contact between the two heat exchangers and in electric contact with the electric motor. In this demonstration model, the module is heated by a propane torch to merely demonstrate current generation while requiring a hand held pyrometer to prevent overheating and destruction of the module. It is clear from this demonstration model that it could not be satisfactorily and reliably used to circulate heat from a hot surface, since sufficiently high temperatures of the hot surface sufficient to provide an effective air circulation effect would cause the thermoelectric module to simply overheat and be destroyed. Further, the orientation of the fan and the cool end heat sink are so located relative to the heat source as to cause passage of the hot gases on the hot side of the thermoelectric module around and through the cool end heat sink. Thus, the Tellurex Corporation demonstration model has no practical and reliable utility as a warm air circulating fan if placed on a heated surface.

Surprisingly, I have found that an air circulation fan powered only by a thermoelectric module obtaining heat available at the heated surface of a heating unit, such as the top Of a stove, can provide useful warm air circulation, notwithstanding the extremely low efficiency of conversion of thermal energy to electrical energy inherent in the Seebeck thermocouple effect. I have found that by judicious selection of components and the physical arrangement of these components to constitute a hot air circulation fan suitable efficacious warm air circulation is reliably and safely obtained. Thus, not only is warm air propelled forward from the unit to provide warm air circulation but that efficient incoming cooler air pulled by the fan operates to enhance cooling of the heat sink cool end and, when appropriately, the hot end of the thermocouple module to provide reduced risk of damage through overheating of the thermocouple module.

Further, I have found that an air circulation fan powered only by a thermoelectric module cooled at the cooling surface of a cooling system, such as, for example, provided by ice/water or a refrigeration system can provide useful air circulation, notwithstanding the extremely low efficiency of conversion of thermal energy to electrical energy inherent in the Seebeck thermocouple effect. I have found that by judicious selection of components and the physical arrangement of these components to constitute an air circulation fan suitable efficacious air circulation is reliably and safely obtained.

SUMMARY OF THE INVENTION

It is an object of the present invention to provide a practical air circulation fan which generates its own electrical power from a temperature difference induced across distinct members of the fan.

It is a further object of the present invention to provide an air circulation fan which generates its own electrical power from an external heat source for use with such heat source, for example a fossil-fuel burning stove.

It is a yet further object of the present invention to provide a fan having heat transfer means controllable by the cooling assistance of the fan blades.

These and other advantages and objects of the present invention will become apparent upon a reading of this specification taken in conjunction with the accompanying drawings.

Accordingly, in its broadest aspect the invention provides a self-powered fan for circulating air in cooperation with a first temperature heat transfer source, said fan comprising a heat transfer means having a heat transfer surface operably cooperably with said first temperature heat transfer source, electric motor, fan blades, thermocouple means cooperable with said electric motor and said heat transfer means, the improvement comprising said heat transfer means being formed of a suitable material and of suitable size, mass and shape as to provide a suitable temperature gradient between said thermocouple means and said first temperature heat transfer source to operably allow of sufficient heat transfer from said heat transfer means to said thermocouple means to generate sufficient power to effect rotation of said blades.

Thus, in a preferred aspect, the invention provides a self-powered fan for circulating warm air in cooperation with a heat source, said fan comprising a heat transfer means having a heat transfer surface operably cooperable with said heat source, electric motor, fan blades, thermocouple means cooperable with said electric motor and said heat transfer means, the improvement comprising said heat transfer means being formed of a suitable material and of suitable size, mass and shape as to provide a suitable temperature gradient between said thermocouple means and said heat source to operably allow of sufficient heat transfer from said heat transfer means to said thermocouple means to generate sufficient power to effect rotation of said blades, but not to cause thermal damage to said thermocouple means.

The invention is of particular value when the heat transfer means comprises a base of the fan which rests upon the top of or is adjacent in contact with a heat source such as a fossil-fuel burning stove, for instance a coal fired or wood burning stove.

The fan according to a preferred aspect of the invention is a device to circulate warmed air from the hot stove surface. The fan uses the difference in temperature between the hot surface of the stove upon which the fan is resting and the surrounding air to power the fan. The power is derived by utilizing a thermoelectric module, preferably consisting of an array of thermocouples. The current generated is used to power a d.c. motor which operates the fan blades to circulate warm air and maintain the temperature difference across the thermocouple. The fan draws all of its power from the heated surface and requires no external electrical power source. Most importantly, the fan stops, starts and runs automatically and provides variable air circulation in proportion to the amount of heat provided to the hot side heat exchanger base and resultant thermocline across the thermocouple module.

By suitable selection of material and the surface area, size, mass and shape of the hot end heat exchanger, suitable temperature gradients between the thermocouple module and the stove can be obtained to operably allow sufficient heat to reach the hot end of the module, without destroying it, and to generate sufficient power to effect rotation of the fan blades. Such suitable determination of material, surface area, size, mass and shape may be readily determined by the skilled person in the art.

Further, more preferably, the hot end heat exchanger comprises a base, which operatively abuts the heat source, and a heat conductive member having a length connecting with the thermocouple for transferring heat thereto. The length of this member is so chosen as to be sufficient as to provide a suitable temperature gradient between the heat source and the thermocouple as to effect blade rotation without damage of the thermocouple by overheating.

To enhance efficiency of the fan in providing warm air circulation and enhanced safety in preventing overheating of the thermocouple module, the fan blades are, preferably, so oriented relative to the hot end heat transfer base as to cause a portion of the ambient air flow to be drawn past the hot end heat transfer base in order to effect a cooling heat transfer effect upon the base. Clearly, it can be seen that the greater the temperature gradient across the module caused by an increase in temperature of the heated base, the greater the power generated with commensurate fan speed. Increased fan speed causes faster air flow around the fan and base to enhance cooling of the latter. Thus, this cooling effect constitute a useful safety feature.

Preferably, the axis of rotation of the fan is angularly displaced, most preferably perpendicularly, to the hot and cold heat transfer means and module.

Also, preferably, the cool end heat exchanger comprises a plurality of cooling vanes dissipating heat from the module. It is highly desirable that the vanes are so disposed relative to the fan blades that the vanes extend through the cool air low stream generated by the rotation of the fan blades. In one embodiment according to the invention the cooling vanes are so disposed one vane to another as to take the form of a fan-shaped array.

Also, preferably, is the optional feature of having the fan blades and associated fan motor so shaped and arranged as to optimize cool air flow both through the cool exchanger core of the thermocouple module and around the fan motor.

Thus, the fan blades are so shaped and located relative to the module and heat exchange means as to cause cooler air to pass adjacent to and/or through the heat sink cool end. In an alternative embodiment of the invention, the fan may have a protective wireframe or shroud to prevent physical injury, and which also is connected to the module to act as a cool end heat exchanger to dissipate heat from the module.

In a more preferred aspect, the invention provides a fan as hereinabove defined further comprising heat transfer control means to physically remove by various degrees the surface of the hot base from the stove surface. This can be achieved by a threaded screw means manually turned, either pre-set when the fan is placed on a stove at an estimated stove temperature; or most preferably, constituted as an automatic separating function constituted as a bimetallic strip overheat protector. Thus, the protector physically breaks surface to surface contact and the conduction of heat to the base of the hot side module and protects the module until the overheat situation is corrected.

The heat exchanger members of the fan may be formed of any suitable material, such as a metal or metal alloy, for example of aluminum, copper and iron.

Hence, fans according to the invention, can provide satisfactory air circulation when the fan module is operative at a temperature gradient of the order of as low as 30° C.,

BRIEF DESCRIPTION OF THE DRAWINGS

In order that the invention may be better understood, specific embodiments may now be described by way of example only with reference to the accompanying drawing wherein:

FIGS. 14A–C represent an alternative fan according to the invention wherein FIG. 14A is a diagramatic frontal view; FIG. 14B is a diagramatic side elevational view; and FIG.14C is an isometric view; and wherein the same numerals denote like parts; full arrows denote air flows, while broken arrows denote fan blade direction of rotation.

DESCRIPTION OF PREFERRED EMBODIMENTS

Figure 1:
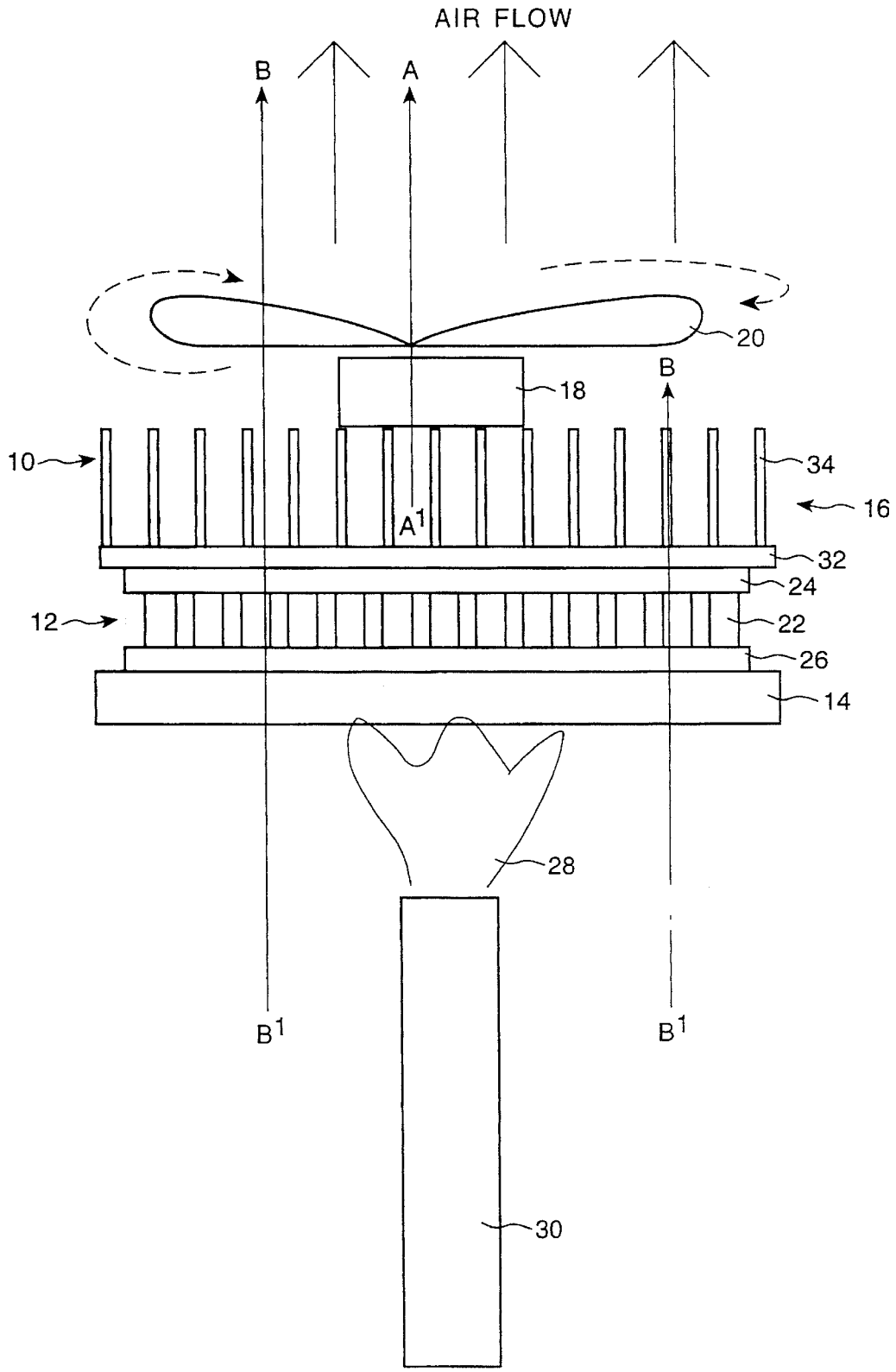
Fig. 1 (PRIOR ART)
FIG. 1 represents a schematic side view of a prior art thermocouple-powered fan activated by a hand held propane gas torch.

With reference to FIG. 1, a prior art demonstration fan shown generally as 10 is constituted of a thermoelectric (TE) power generation module (part number pg-4-71-1.9, Tellurex Corporation, Michigan, U.S.A.) 12, sandwiched between hot end heat exchanger 14 and cold end heat exchanger 16, and in electrical contact with a d.c. electric motor 18, which drives fan 20. Fan is 33 cm high and 11 cm wide on a 20 cm×10 cm base.

Module 12 is comprised of an array of semiconductor couples (P and N pellets) 22 connected electrically in series and thermally in parallel sandwiched between metallized ceramic substrates 24, 26.

Exchanger 14 is formed of a rectangular slab or plate formed of aluminum, which is carefully heated by a flame 28 of a hand-held propane torch 30. Care must be taken to avoid damage to module 12 which cannot accept temperatures above 200° C. Heat transfer member 14 is used to spread the heat received from flame 28 evenly over module 12 and to physically connect module 12 between heat sinks 14, 16 to achieve heat transfer.

Exchanger 16 has a base 32 and a plurality of heat dissipating veins 34 formed of aluminum.

Motor 18 and fan blades 20 have a common axis represented by the axis of rotation line A—A'. In the prior art device 10, module 12 and heat transfer members 14 and 16 have imaginary common perpendicular lines B—B' drawn through module 12 and transfer members 14 and 16 which is parallel to line A—A'.

It can be readily seen that heat transfer member 14 provides no control of the amount of heat transferred from flame 28, via member 14 to module 12. The rate of heat transfer is limited only by the conductive qualities of member 14, temperature of flame 28 and the distance thereof from member 14. Manual control of such temperature and distance of flame 28 from member 14 is essential to avoid irreparable damage to module 12.

Fan 10 is provided in the prior art merely as a demonstration device to demonstrate visible feedback that module 12 in fan 10 can produce d.c. current by producing air flows in the general direction shown by arrows.

Figure 2:
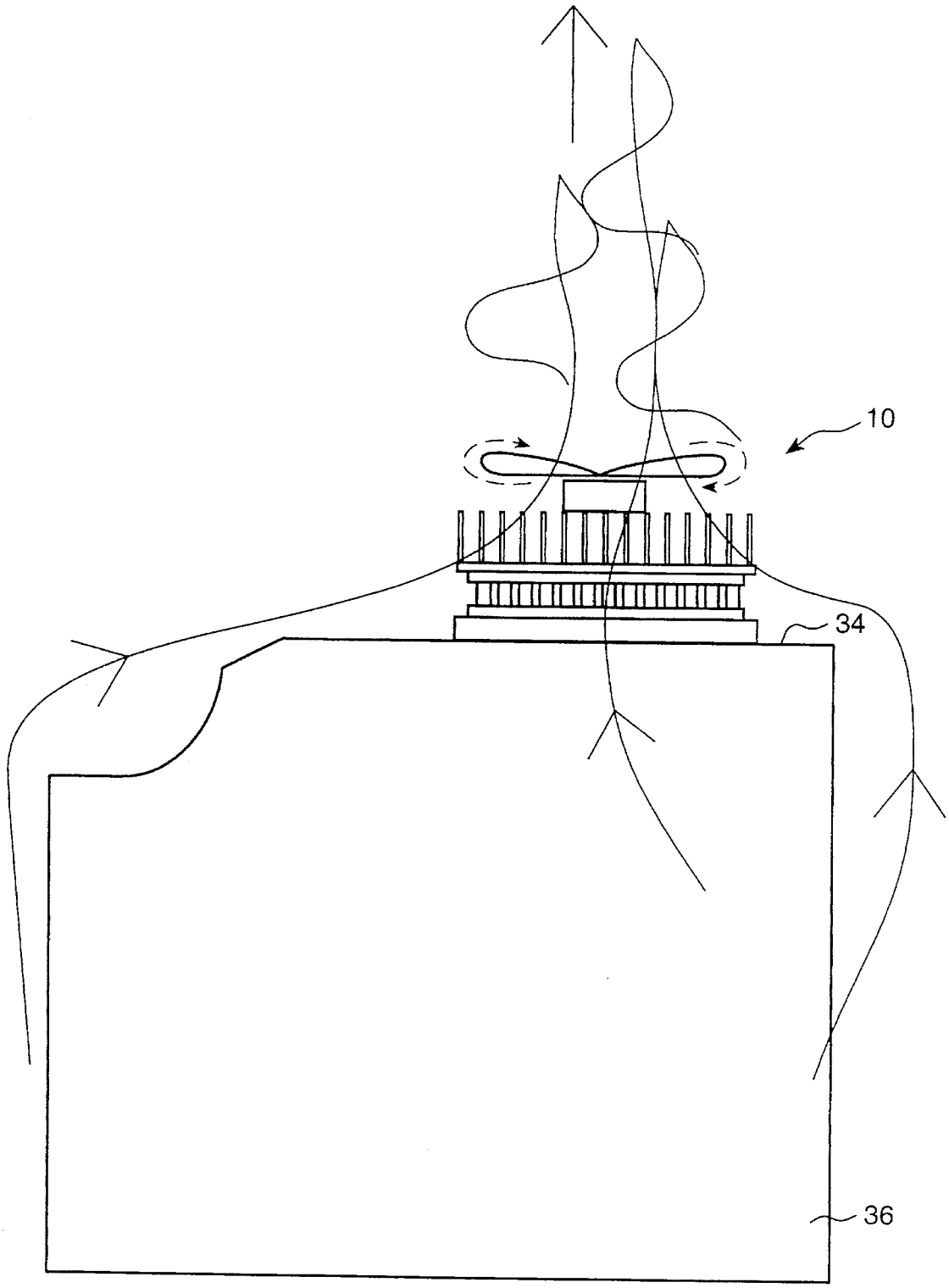
Fig. 2 (PRIOR ART)
FIG. 2 represents a schematic side view of the prior art fan of FIG.1 on top of a stove showing expected air flows.

FIG. 2 shows the direction of convection air currents generated when fan 10 rests on the upper surface 34 of stove 36. If stove 36 is hot when fan 10 is placed on stove surface 34, fan 10 would start to turn as a result of the thermocline between the room temperature coolside heat sink 16 and hotside heat sink 14 in contact with stove surface 34. Propellers 20 would turn and draw superheated air from around surface 34 and that coming up from the sides of the stove, causing heating of coolside exchanger 16. The heat coming through module 12 will also raise the temperature of coolside heat exchanger 16. As the temperature of coolside exchanger 16 increases, the amount of current produced by module 12 decreases and propeller 20 will rotate slower. The combination of the heat passing through module 12 and the heat drawn through heat exchanger 14 will rapidly cause module 12 to overheat and be destroyed. Thus, fan 10 cannot be employed in this fashion. The only way fan 10 will perform its task is if a small, controlled heat source, such as torch 30, is applied directly to hotside heat exchanger 14 and is monitored so it does not overheat and is removed when the critical temperature is neared. It can, thus, only be used to demonstrate that the TE modules produce electricity—which is its intention as a demonstration model.

Figure 5:
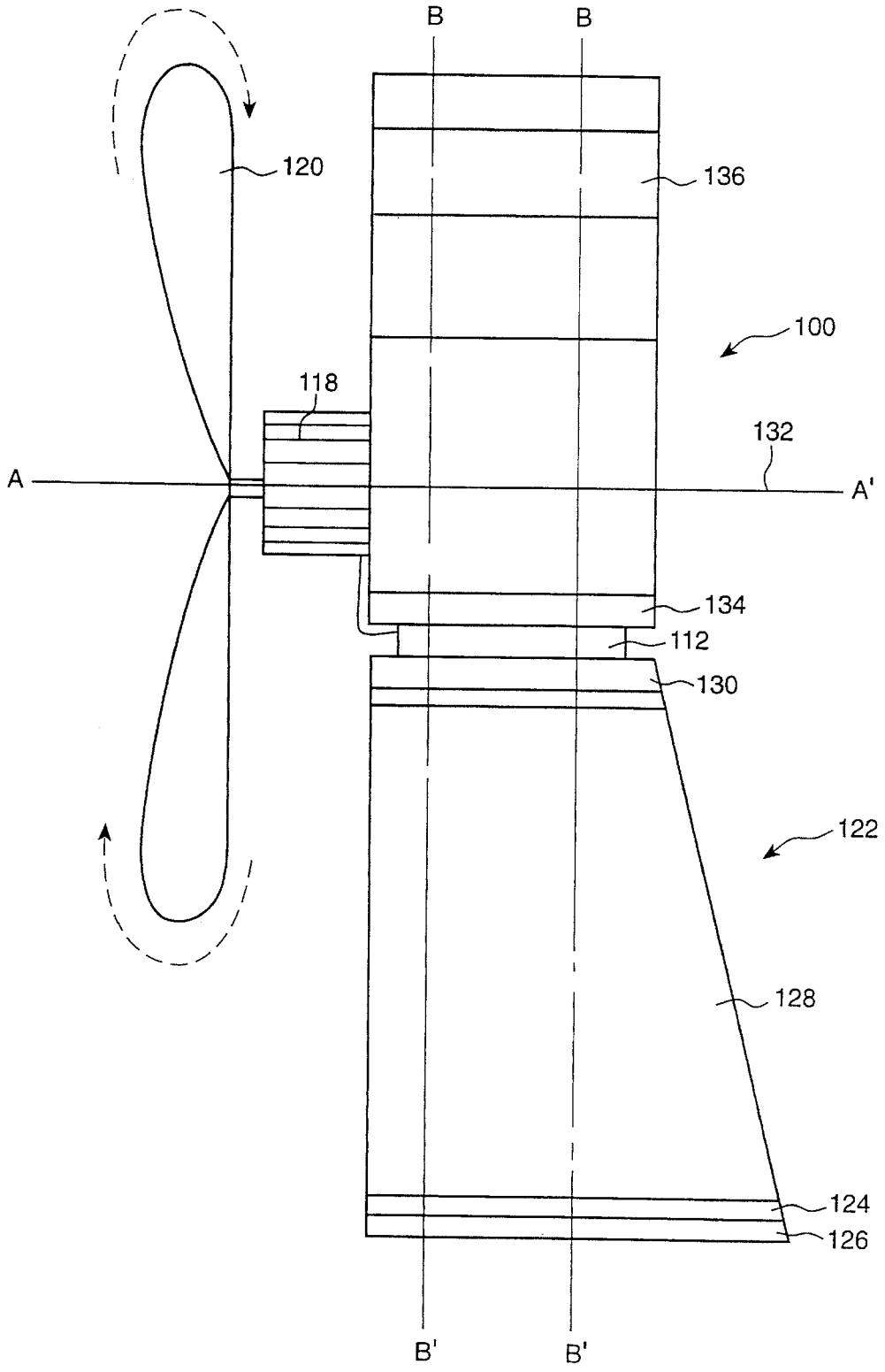
FIG. 5 represents a schematic side view of a fan according to the invention.
Figure 6:
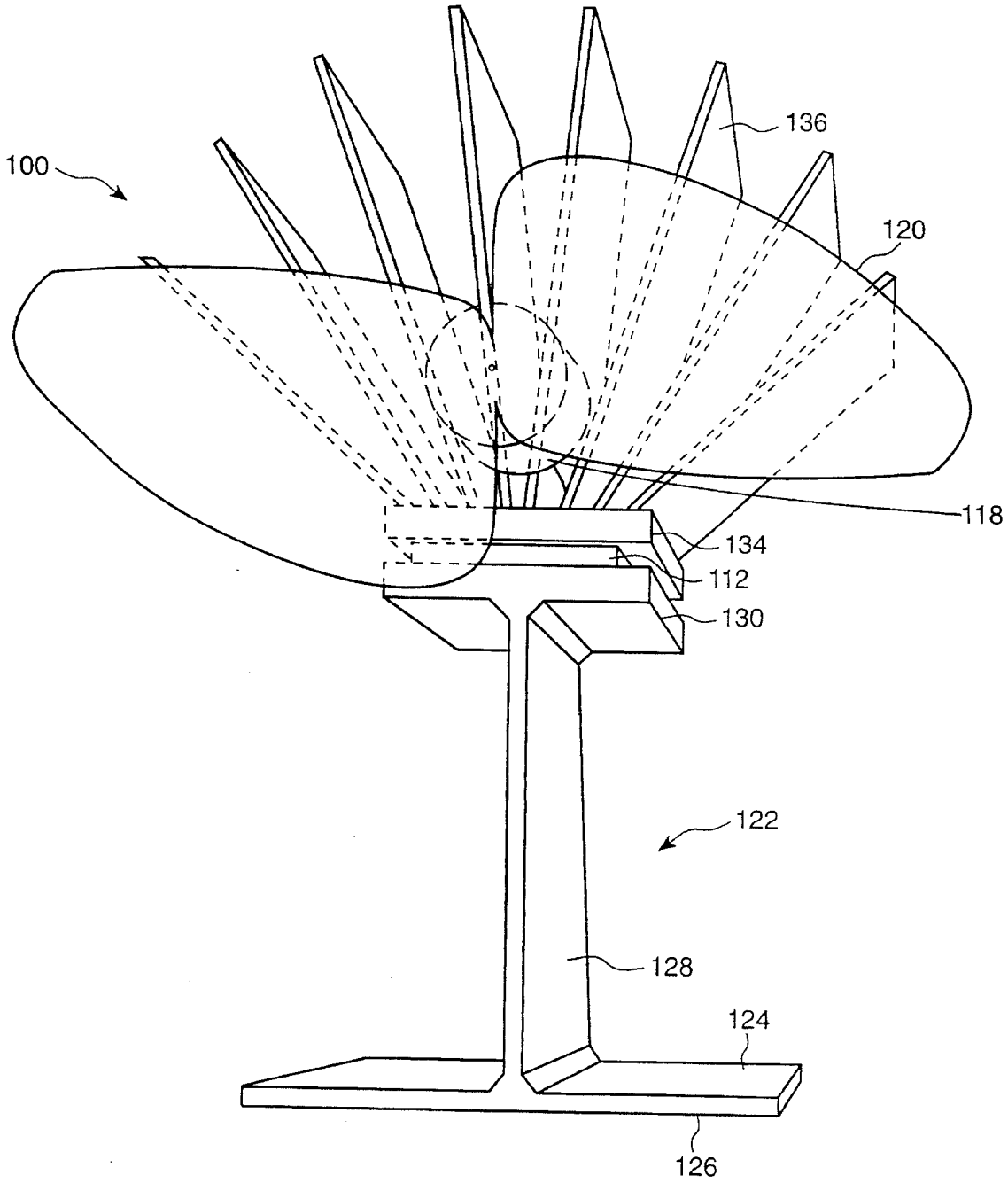
FIG. 6 represents an isometric view of the fan shown in FIG. 5.

With reference to FIGS. 5 and 6, fan 100 of the present invention comprises a TE module 112 (cpl. 0-127-08L Melcor Frigichips, U.S.A.) basically of similar construction as module 12 of FIG. 1. This module can withstand temperatures only up to about 80° C. Module 112 has an electrical connection with motor 118 which, drives fan blades 120, shown in outline only for clarity.

Fan 100 has a heat transfer member, shown generally as 122 having a rectangular-shaped base portion 124 having a lower surface 126 in operable contact with a heated surface of a stove or the like (not shown). Upstanding from rectangular base member 124 is a vertically aligned planar heat transfer portion 128 upon which is formed a heat transfer portion 130. Member 122 is thus constituted by integrally formed portions 124, 128 and 130 formed of aluminum. Portion 130 is in thermal communication with the lower ceramic member of module 112, as was similarly described with respect to prior art fan 10.

Above module 112 and in thermal communication therewith is a cool end heat exchanger 132 formed of aluminum and consisting of a base 134, connected to module 112, and an array of vanes 136.

Portion 128 is so shaped as to provide the necessary heat control of heat from portion 124 to module 112, irrespective of the temperature, within reasonable limits, of the stove heat source, as hereinafter more fully explained. Stove temperatures of up to, for example, 500° C. may be obtained in practice and acceptable to fans according to the present invention.

Thus, the mass and shape of base 124 and the distance or length, mass and shape of 128 between base 124 and module 134 is such as to provide a suitable temperature gradient between base 124 and module 134 as to cause sufficient current generation for desired fan rotation without damage of module 134 by heat when the heated stove furnace is at a temperature of not greater than 500° C.

Figure 3:
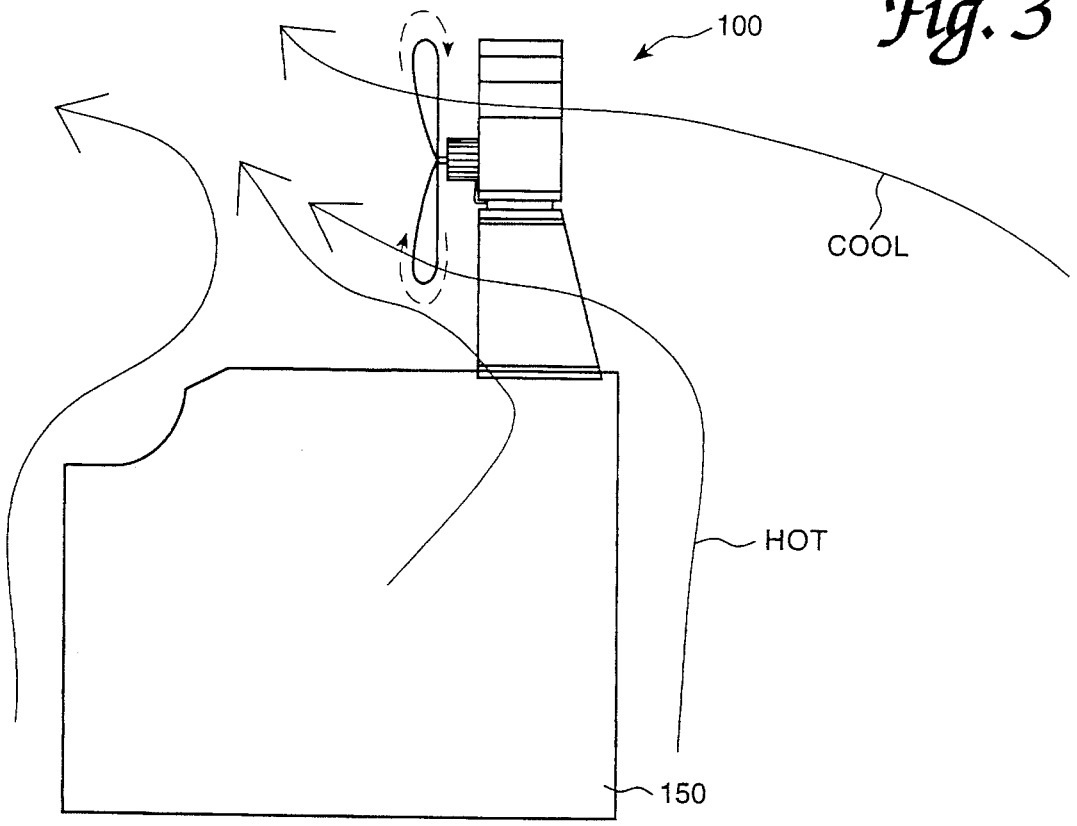
FIG. 3 represents a schematic side view of a fan according to the invention on top of a stove with a low fire and showing expected air flows.
Figure 4:
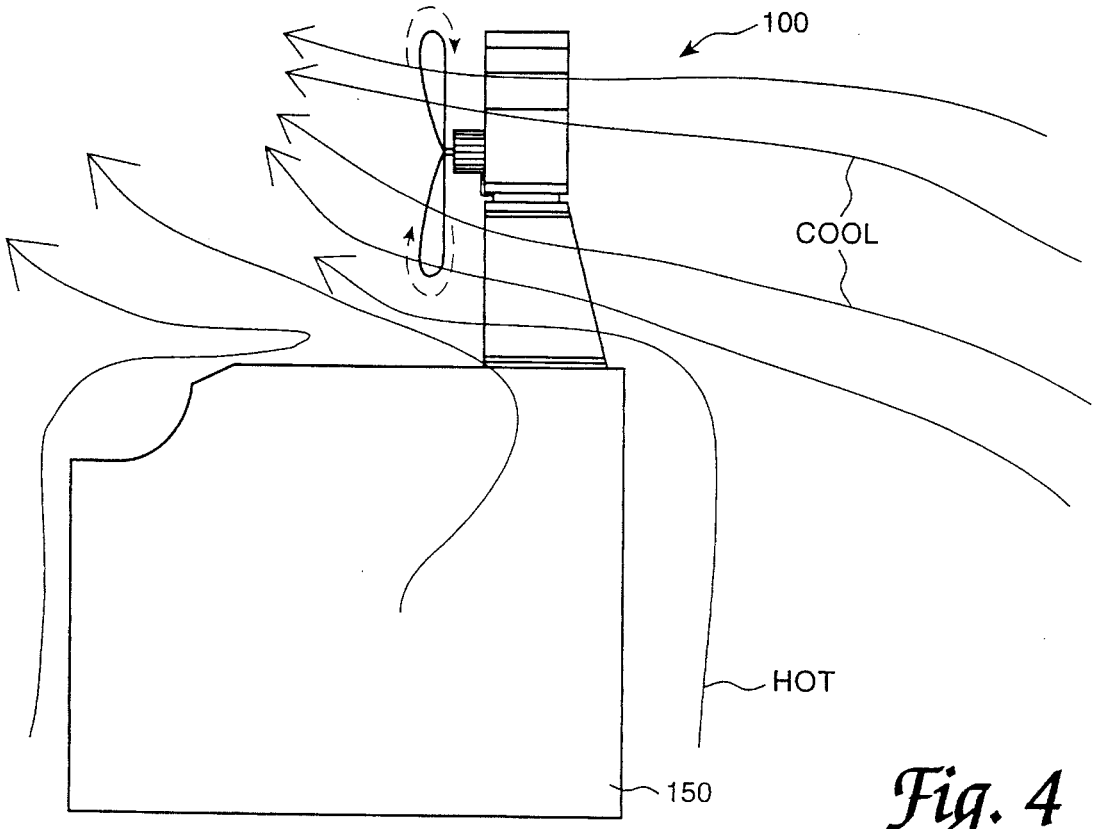
FIG. 4 represents a schematic side view of a fan according to the invention on top of a stove with a high fire and showing expected air flows.

Reference is now made to FIGS. 3 and 4 which show fan 100 on top of a stove 150.

FIG. 3 depicts gentle air circulation created by stove 150 having a low fire and, thus, low heat transfer therefrom to module 112, via heat transfer member 122. In this situation, low power generation occurs due to a relatively small thermocline. Thus, fan 100 produces a gentle air circulation that bends the superheated air from the convection stream and sends it forwards into the area in front of stove 150. The airflow is sufficient to bring cool room temperature air through the coolside heat exchanger to maintain a thermocline across module 112 and produce enough current to maintain an adequate air circulation. The superheated convection currents are allowed to pass the base, or hotside heat exchanger and maintain as large a thermocline as is necessary.

FIG. 4 depicts air circulation created by stove 150 having a high fire. The increase in heat provided by the high fire provides more current for fan 100 and the resultant air passing through fan 100 increases greatly. The superheated air from convection is now being pushed rapidly across the stovetop and cool room temperature air flows through the coolside exchanger as in the earlier example, and is also drawn past the hotside exchanger. This latter process is absolutely critical to the operation of the unit as it strips heat from the hotside exchanger before it reaches module 112 and keeps module 112 well within operational tolerances with regard to temperature. Thus, provided that the shape, mass, size and material composition of heat transfer member 122 is suitable selected, efficient cooling of member 122 by the rapid cool air flow will prevent excess heat transfer to and damage of module 112.

Figure 7:
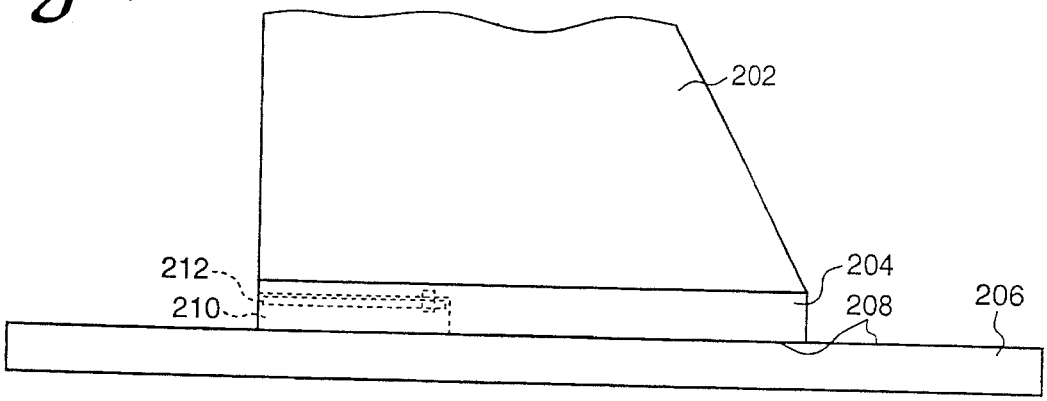
FIG. 7 represents a schematic side view, in part, of the lower base of a fan according to the invention having a bimetallic strip overheat protector in an inactive position, on a stove surface.
Figure 8:
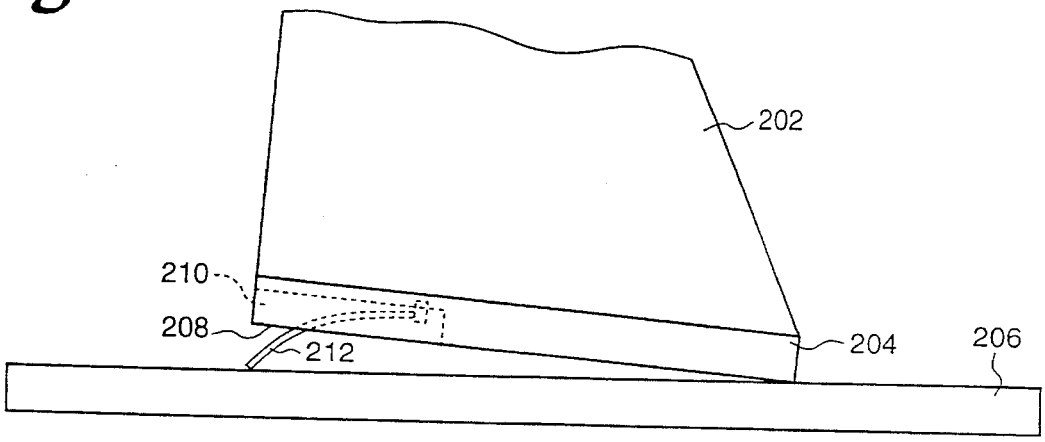
FIG. 8 represents a schematic side view of the base of FIG. 7 having the overheat protector in an activated position.

FIGS. 7 and 8 represent a preferred embodiment of a fan according to the invention having an additional safety feature to that related to the physical properties of material, size, shape and mass of the hot end heat transfer member 122.

FIG. 7 represents part of a hot end heat transfer member 200 having a vertical portion 202 and a stove contacting heat transfer base portion 204, resting on stove 206 through base portion surface 208.

Base portion 204 has a recess 210 within which is located a bi-metallic strip overheat protector 212, shown in its contracted state. Strip 212 is so shaped, sized and located within recess 210 that expansion of strip 212 occurs proportionately to the temperature attained by base portion 204 through heat transfer from stove 206. By suitable pre-setting arrangement and adjustment of strip 212 with recess 210, the degree to which strip 212 expands to effect gradual lifting of base portion 204 above stove 206 and, thus, reducing the amount of contact of surface 208 with the top of the stove can be automatically controlled. Thus, not only can overheating of TE module be automatically prevented, but that maximum efficiency of power generation and, thus, fan air circulation can safely be achieved.

FIG. 8 shows the bi-metallic strip 212 in an expanded mode with the resultant-separation of base 204 from stove 206.

Figure 9:
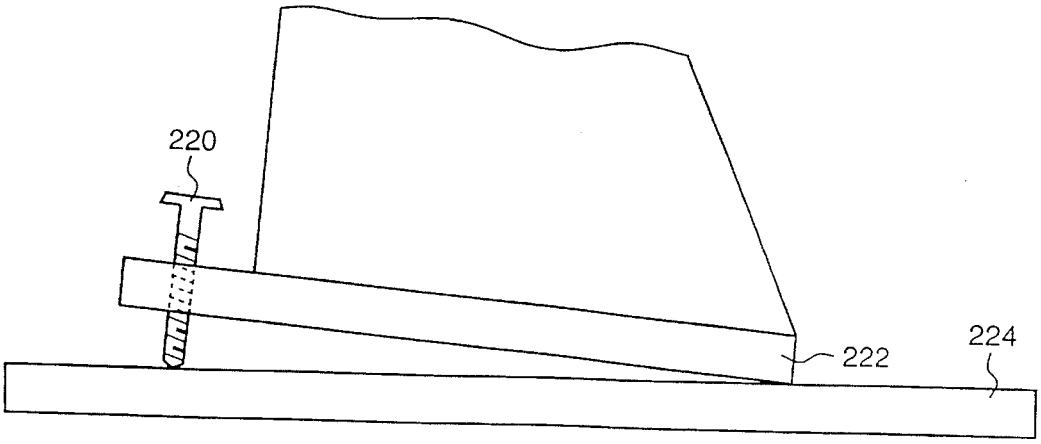
FIG. 9 represents a schematic side view, in part, of the lower base of a fan according to the invention with a screw type overheat protector; wherein like parts in the drawings are denoted with the same numerals.

FIG. 9 shows an alternative heat transfer control means constituted as a manually operated screw 220, fitted to hot end base portion 222. Screw 220 may be either pre-set before contacting a hot stove surface or adjusted in a timely fashion when appropriate to vary the amount of surface contact between heat transfer base 222 and the stove.

Figure 10:
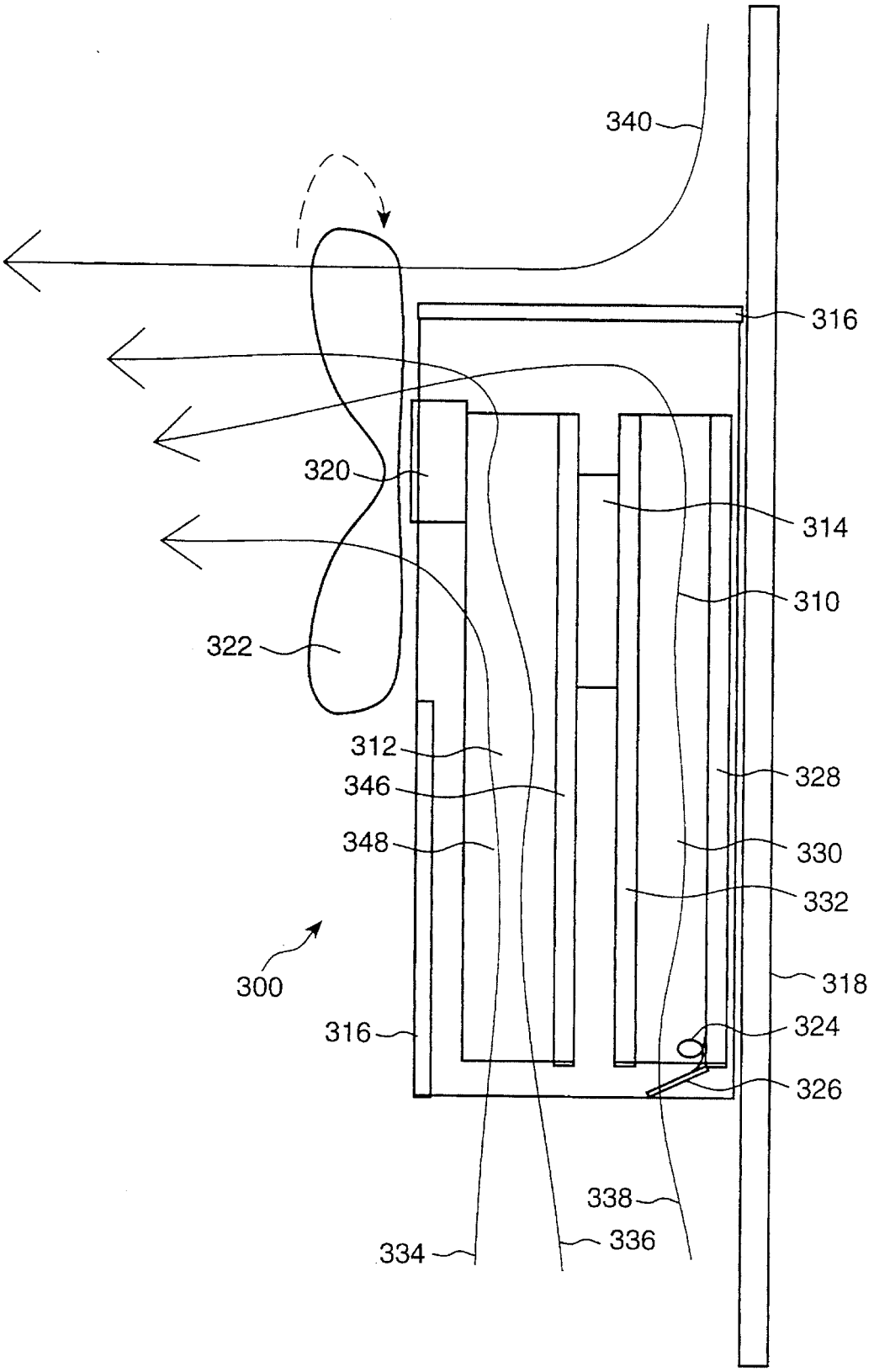
FIG. 10 represents a schematic side view of a fan according to the invention with a stove front or side.
Figure 11:
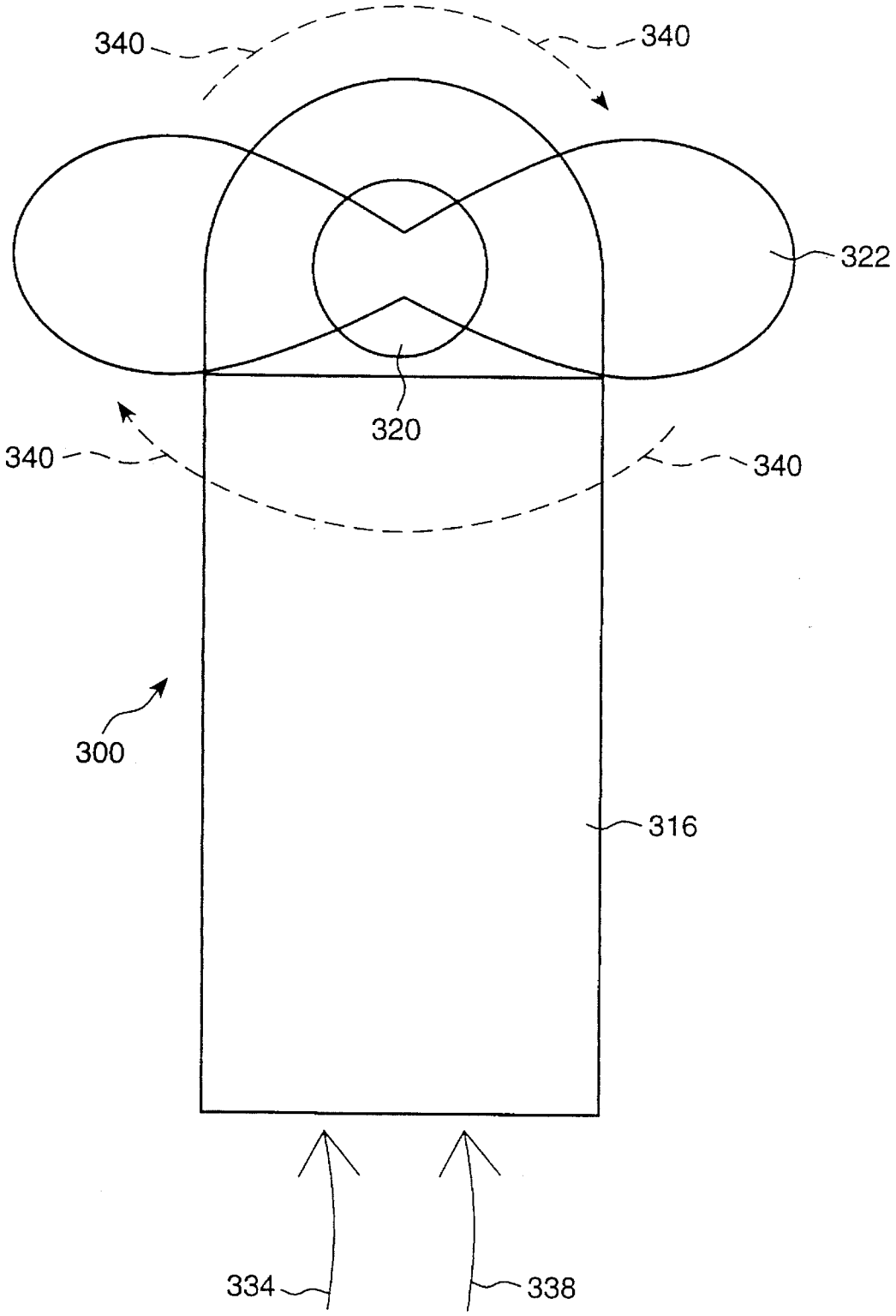
FIG. 11 represents a schematic front view of a fan of FIG. 10.

With reference to FIGS. 10 and 11, fan 300 is a fan according to the invention designed to operate attached to the front or side of a stove. A variety of methods of connecting fan 300 to the stove is available, but a specific method of attachment to the stove of this embodiment is not shown in the drawings for the purpose of clarity. Some methods of attachment may use a bracket that hangs from the stove door, as in the case of a glass front fireplace insert. Another method may use a magnetic pad to attach the fan directly to the door if the door contains appropriate materials to accommodate this method.

The method of operation of fan 300 is the same as for fan 100 except that fan 300 has a housing 316 employed to achieve correct air flow through the hot and cold heat exchangers.

With reference to FIG. 10, fan 300 comprises a TE module 314 (cp 1.4-71-10L Melcor Frigichips, U.S.A.) basically of similar construction as module 12 of FIG. 1. TE module 314 can withstand temperatures only up to about 80° C. Module 314 has an electrical connection (not shown for clarity) to motor 320.

Fan 300 has a hot end heat transfer member, shown generally as 310 having a rectangular base portion 328 in direct contact with the front or side of-stove 318. Portion 328 has one or more fins mounted perpendicularly to member 328 and is connected to an interface portion 332 which is in direct contact with module 314. Thus, member 330 provides heat transfer from stove surface 318 to module 314, while at the same time providing an air channel for removal of excess heat in overheat situations.

Cool end heat exchanger, shown generally as member 312 is in thermal contact with TE module 314 through rectangular base portion 346 while having an array of vanes 348. Thus, exchanger 312 provides cooling for module 314. Motor 320 drives a propeller 322.

Housing 316 is employed to direct the flow of cooling air to cool end exchanger 312 and hot end exchanger 310 as required. A bi-metallic loop controls a damper 326 and when hot end exchanger 310 exceeds a pre-set heat value, damper 326 opens further to allow more cooling air to flow past the heat exchanger.

In this embodiment, the axis of rotation of propeller 322 and motor 320 is parallel to the imaginary common perpendicular lines drawn through hot and cold heat transfer members, 310, 312, respectively and module 314.

In operation, portion 328 adjacent to stove 318 becomes hot, and heat is transferred to hot end exchanger 310. This creates a thermocline across module 314 and generates a current that is used to rotate propeller 322. Cool air is drawn into housing 316 from the relatively cool air at the base of stove 318. This air flow maintains the cool temperature of cool end exchanger 312. Should the hot end exchanger begin to heat up to the safety limits of module 314, bi-metallic strip 324 will further open damper 326 and remove excess heat from hot end exchanger 310. The portions of fan blade 322 extending beyond housing 316 will force superheated air surrounding the front of stove 318 outwardly into the surrounding space of a room to provide more efficacious warming thereof.

Operational air flows are designated by arrows 334, 336, 338 and 340 to various degrees.

With reference to FIG.11, this shows a front view of fan 300 as it appears against stove 318. Cool air is drawn into housing 316 as shown by arrows 334 and 338. Fan blades 322 draw air through housing 316. Portions of fan blades 322 extending beyond housing 316 push heated air 340 outwardly into the room.

It will be clearly seen that the mass, surface area, shape and size of member 328 can be readily determined to provide the sufficient cooling surface area to effect the desired cooling to prevent overheating of module 314, proportional to the thermocline, current generated and fan speed effecting varied air cooling of the hot end heat exchanger, as appropriate.

Figure 12:
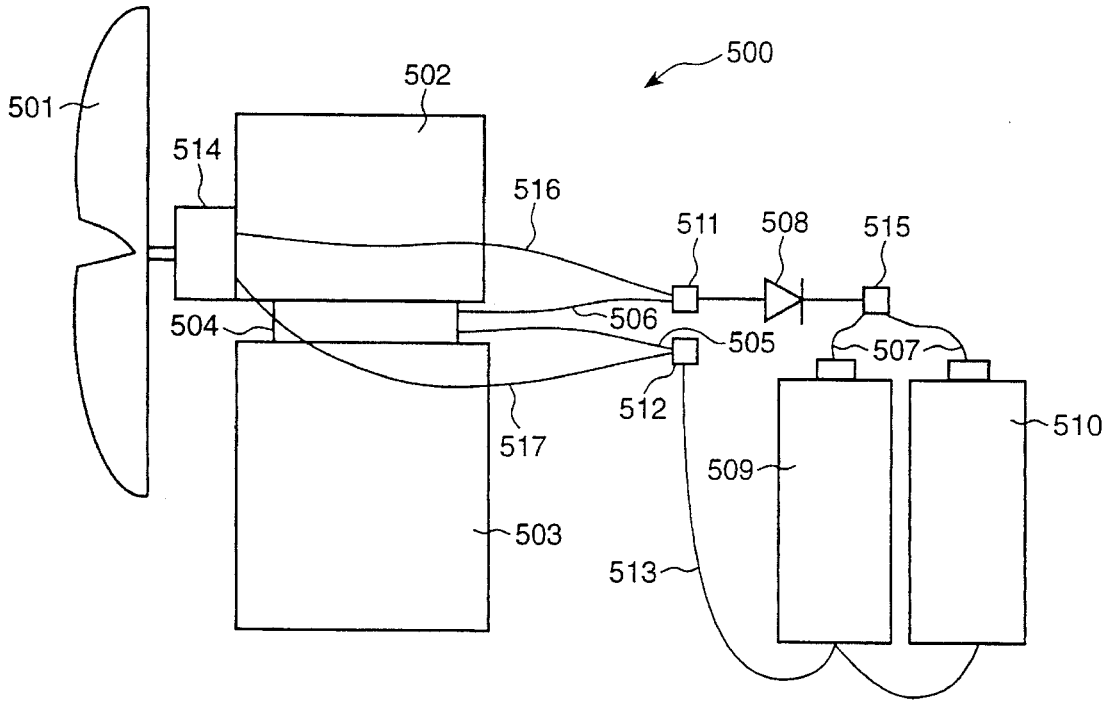
FIG. 12 is a diagramatic view of a fan according to the invention in association with a chargeable power source.

With reference now to FIG. 12, a stove top fan, generally shown as 500, according to the invention, is associated with a rechargeable battery power source, operably to be charged by fan 500, while still being operative as an air circulation unit.

Fan 500 has blades 501, a cool end heat exchanger 502, a hot end heat exchanger 503 and a TE thermocouple module (cpl. 0-127-081, Melcor Fragichips, U.S.A.). The use of a plurality of modules or a more efficient module enables the generation of more power than necessary to efficiently drive blades 501 by motor 514. The excess power may be tapped through diode 508 to rechargeable storage batteries 509 provided 510. Diode 508 is, optionally, required to prevent the reverse flow of current to motor 514 from batteries 509, 510, when the output voltage of the Seebeck module 504 falls lower than the voltage of batteries 509, 510. By the addition of more modules in series and connecting them to output terminal 511 and 512 via electrical connections 505 and 506, a wide range of voltage and power requirements can be met. Motor 514 is connected directly to connections 511 and 512 by electrical connections 516 and 517. Electrical connection 513 supplies the negative connection to batteries 509 and 510 and electrical connection 507 supplies the electrical connection to the positive voltage at the output terminal 515 of batteries 509, 510.

Batteries 509, 510 may be storage batteries with voltages of 1.5 volts–12 volts and higher. When these batteries are charged, they could be removed to power any standard battery powered appliance. The batteries could also be used as a backup power source to operate automatic stove regulating equipment, such as powered draft and air intakes as well as fuel feed augers that control the heat output of the stove.

Figure 13:
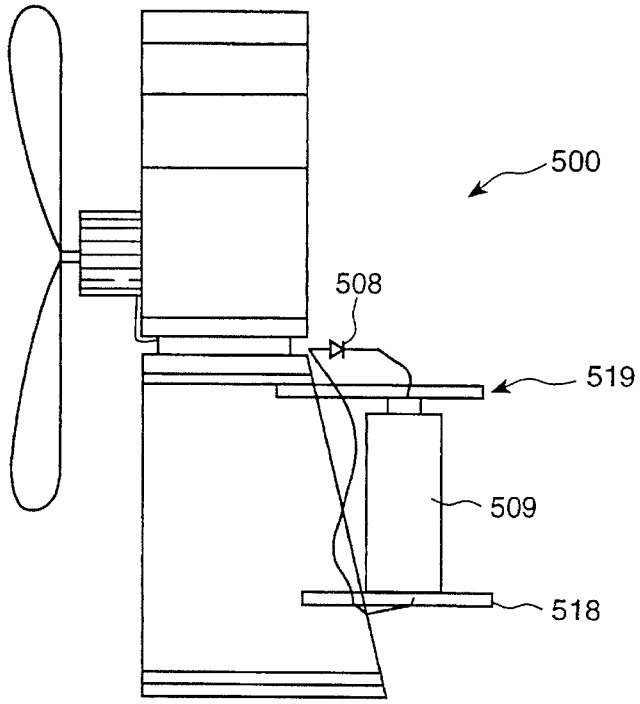
FIG. 13 represents diagramatic side view of a fan according to the invention in association with a chargeable power source.

FIG. 13 represents a fan according to the invention of use in charging a single rechargeable battery 509 mounted on the rear of a fan 500 between mounting brackets 518 and 519.

Figure 14A:
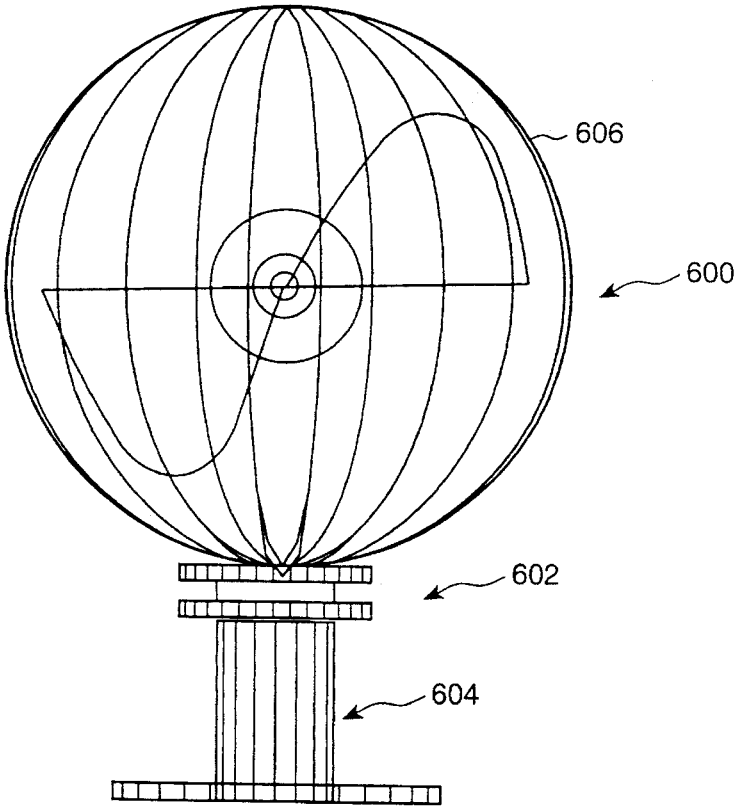
Figure 14B:
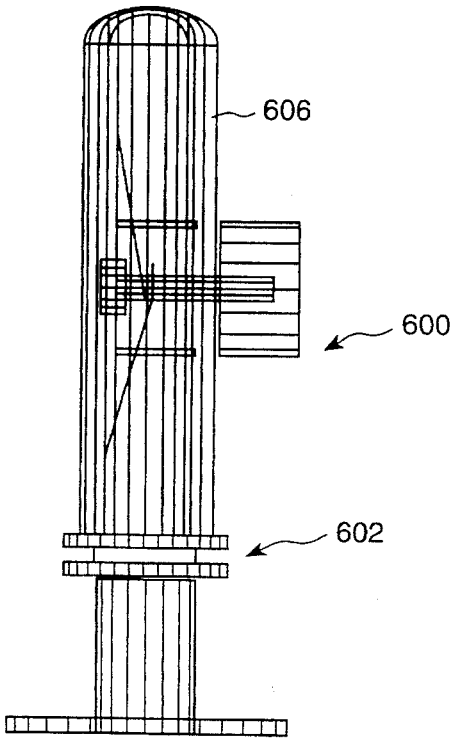
Figure 14C:
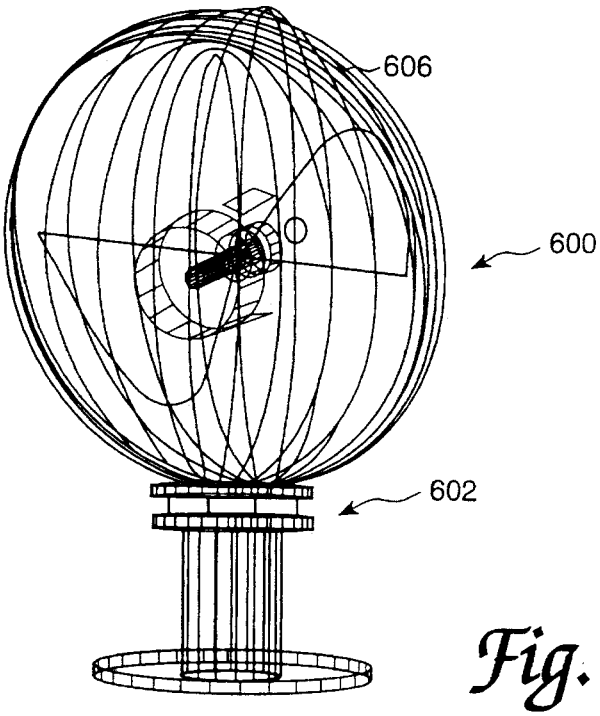

FIGS. 14A–14C, show generally as 600, a fan having a module 602 associated with a hot end heat transfer cylindrical member 604 and a cool end heat transfer wire protective shroud 606. Cylindral member 604 has a base 608 that operably rests on a heated surface (not shown).

While the invention has been described in detail and with reference to preferred embodiments thereof, it will be apparent to one skilled in the art that various changes and modifications can be made therein without departing from the spirit and scope thereof.

I claim:

1. A self-powered fan for circulating air for use in cooperation with a heat source, said fan comprising a first heat transfer member having a first heat transfer surface thermally and physically connected with said heat source, electric motor, fan blades which operably create a first or warm air flow and a second or cooler air flow, a second heat transfer member having a second heat transfer surface, thermocouple structure cooperable with said motor, said first heat transfer member and said second heat transfer member, the improvement comprising said first heat transfer member being of suitable material, size, mass and shape as to provide a suitable temperature gradient between said thermocouple structure and said heat source to operably allow of such sufficient heat transfer from said first heat transfer member to said thermocouple structure to generate sufficient power to effect rotation of said blades, but not to cause thermal damage to said thermocouple structure; and wherein said fan blades are constructed and arranged to cause a portion of said second air flow to be drawn past said first heat transfer surface to effect a cooling heat transfer effect upon said first heat transfer member.

2. A fan as claimed in claim 1 wherein said first heat transfer member, said thermocouple structure and said second heat transfer member have an imaginary common perpendicular line drawn therethough; said fan blades have an axis of rotation; and wherein said axis of rotation is angularly displaced from said common perpendicular line.

3. A fan as claimed in claim 2 wherein said axis of rotation is substantially perpendicular to said common perpendicular line.

4. A self-powered fan for circulating air in combination with a heat source having a heated surface, said fan comprising:

a base portion having a surface constructed and arranged to contact the heated surface of the heat source, a heat transfer portion extending form said base, said heat transfer portion having first and second ends, said first end being coupled to said base, a thermoelectric module having first and second end surfaces, said first end surface being mounted on said second end of said heat transfer portion such that said heat transfer portion conducts heat to said thermoelectric module, heat exchange structure mounted on said second end surface of said thermoelectric module so as to control an amount of heat conducted top said thermoelectric module, an electric motor electrically coupled to said thermoelectric module, and fan blades coupled to said electric motor, whereby said heat transfer portion is constructed and arranged to provide a suitable temperature gradient between said thermoelectric module and said heat source to allow sufficient heat transfer from said heat transfer portion to said thermoelectric module to generate sufficient power to said motor to effect rotation of said blades without causing thermal damage to said thermoelectric module, said fan blades being constructed and arranged relative to said base portion and heat transfer portion to cause a portion of ambient air flow to be drawn past said base portion and heat transfer portion effecting cooling of said base portion.

5. The combination according to claim 4, wherein said heat transfer portion is constructed and arranged to limit heat transfer from said base portion to said thermoelectric module such that when said heated surface is at a temperature of 500° C. or less, the temperature of said module will not exceed 80° C.

6. The combination according to claim 4, further comprising a bi-metallic strip mounted with respect to said surface of said base portion, said strip being expandable proportional to a temperature of said base portion such that at a predetermined temperature, said strip expands to lift said base portion from said heat source reducing an amount contact between said surface and said heated surface.

7. The combination according to a claim 4, further comprising a manually operated screw coupled to said base portion so as to adjust an amount of contact between the base portion surface and the heat source surface.

8. The combination according to claim 4, wherein said heat transfer portion and said heat exchange structure are formed from a material selected form aluminum, aluminum alloy, cooper, cooper alloy and an iron containing material.

* * * * *